US009943152B2

(12) United States Patent
Law et al.

(10) Patent No.: US 9,943,152 B2
(45) Date of Patent: Apr. 17, 2018

(54) LOCKABLE LIDDED CONTAINERS

(71) Applicant: MAGMATIC LIMITED, Bristol (GB)

(72) Inventors: Robert Law, Bristol (GB); Joe Allam, Bristol (GB)

(73) Assignee: MAGMATIC LIMITED, Bristol (GB)

( * ) Notice: Subject to any disclaimer, the term of this patent is extended or adjusted under 35 U.S.C. 154(b) by 380 days.

(21) Appl. No.: 14/398,931

(22) PCT Filed: May 7, 2013

(86) PCT No.: PCT/GB2013/051177

§ 371 (c)(1),
(2) Date: Nov. 4, 2014

(87) PCT Pub. No.: WO2013/167881

PCT Pub. Date: Nov. 14, 2013

(65) Prior Publication Data

US 2015/0114775 A1 Apr. 30, 2015

(30) Foreign Application Priority Data

May 8, 2012 (GB) ..... 1208040.4
Jul. 16, 2012 (GB) ..... 1212601.7

(51) Int. Cl.
*E05C 19/00* (2006.01)
*A45C 13/12* (2006.01)
*A45C 13/10* (2006.01)

(52) U.S. Cl.
CPC ..... *A45C 13/123* (2013.01); *A45C 13/1076* (2013.01); *A45C 13/126* (2013.01)

(58) Field of Classification Search
CPC ..... A45C 5/00; A45C 13/103; A45C 5/14; A45C 13/10; A44B 19/301
(Continued)

(56) References Cited

U.S. PATENT DOCUMENTS 1,855,583 A 4/1932 Mitchell
3,402,441 A * 9/1968 De Woskin ..... A41F 11/04 24/487
(Continued)

FOREIGN PATENT DOCUMENTS

DE 7147241 U1 4/1972
DE 7901593 U1 4/1979
(Continued)

OTHER PUBLICATIONS

ISR in GB1212601.7 dated Nov. 16, 2012.
(Continued)

*Primary Examiner* — Fenn C Mathew
*Assistant Examiner* — Cynthia Collado
(74) *Attorney, Agent, or Firm* — Mossman, Kumar & Tyler, PC

(57) ABSTRACT

A container (1) has first and second body portions, (2,3) and a closure device operable to hold the first and second body portions (2,3) in a closed 5 position. The closure device comprises an engagement element (5) which extends from the first body portion (2) of the container, and a clasp (6) attached to the second body portion (3) of the container (1), and releasably engageable with the engagement element, thereby to hold the second body portion (3) in position with respect to the first body portion (2).

8 Claims, 10 Drawing Sheets

(58) Field of Classification Search
USPC ..... 190/120, 100, 119, 13 E, 8, 1, 18 A; 70/69; 108/127; 292/129; 224/271; 24/273, 671
See application file for complete search history.

(56) References Cited

U.S. PATENT DOCUMENTS

| | | | | |
|---|---|---|---|---|
| 4,509,622 | A | 4/1985 | Morszeck | |
| 5,438,853 | A * | 8/1995 | Bartsch | E05B 15/0006 292/242 |
| 6,032,988 | A * | 3/2000 | Klein | A45C 13/10 292/113 |
| 6,244,066 | B1 | 6/2001 | LaRose | |
| 6,547,293 | B1 * | 4/2003 | Cheng | E05C 19/14 292/113 |

FOREIGN PATENT DOCUMENTS

| | | | |
|---|---|---|---|
| DE | 20005938 | U1 | 10/2000 |
| DE | 202009005257 | U1 | 11/2009 |
| FR | 2862190 | A1 | 5/2005 |

OTHER PUBLICATIONS

ISR and Written Opinion in PCT/GB2013/051177 dated Jun. 10, 2013.
Examination Report in Chinese Appln. 201380022977.7 dated Sep. 2, 2015.

* cited by examiner

LOCKABLE LIDDED CONTAINERS

The present invention relates to containers.

BACKGROUND OF THE INVENTION

Containers, such as suitcases and the like, must be held in a closed position, for security and convenience. It is desirable to provide a closure device for such containers that can be straightforward and cost effective to manufacture, and that can be assembled simply and reliably. It is also desirable to provide a robust and simple locking mechanism for such containers and closure devices.

SUMMARY OF THE INVENTION

According to one aspect of the present invention, there is provided a container having first and second body portions, and a closure device operable to hold the first and second body portions in a closed position, the closure device comprising an engagement element which extends from the first body portion of the container, and a clasp attached to the second body portion of the container, and releasably engageable with the engagement element, thereby to hold the second body portion in position with respect to the first body portion, wherein the clasp comprises a locating element which extends from the second body portion of the container and which defines a locating aperture therethrough, a clasp body defining at one end region thereof an engagement portion for engagement with the engagement element, and having an elongate pivot portion located at another end region thereof, a hinge element rotatably mounted on the pivot portion of the clasp body, and having a partially cylindrical portion which extends substantially around the pivot portion, and first and second retaining portions which extend from respective ends of the partially cylindrical portion, and which extend adjacent one another through the locating aperture of the locating element.

In one example, the hinge element is of resilient material, and is arranged such that the first and second retaining portions thereof are biased to diverge from one another, thereby providing a friction fit within the locating element.

In one example, the first and second body portions, the locating element, the clasp body, and hinge element are of moulded plastics material.

In one example, the clasp further comprises a locking element which engages with the first and second retaining portions, and locks the first and second retaining portions in the locating element.

In one example, the locking element is integral with the second body portion, and is movable with respect to the second body portion into engagement with the first and second retaining portions.

In one example, the locking element is of a plastics material and is moulded with the second body portion, the locking element being connected to the second body portion by way of a moulded hinge.

In one example, the clasp body is movable between a closed position in which the engagement portion thereof is engaged with the engagement element, and an open position in which the engagement portion is not engaged with the engagement element.

In one example, the container includes a locking mechanism comprising a lock body, a button resiliently mounted on the lock body, for movement with respect to the body, the button defining an interference element that extends into the lock body, a lock rotatably mounted on the lock body, and defining a slot and a retaining surface, and rotatable between a locked position in which the interference element is substantially engaged with the retaining surface, thereby preventing movement of the interference element into the lock body, and an unlocked position in which the slot is substantially aligned with the interference element, such that the interference element is movable into the slot in a direction into the lock body.

DETAILED DESCRIPTION OF THE PREFERRED EMBODIMENTS

Figure 1:
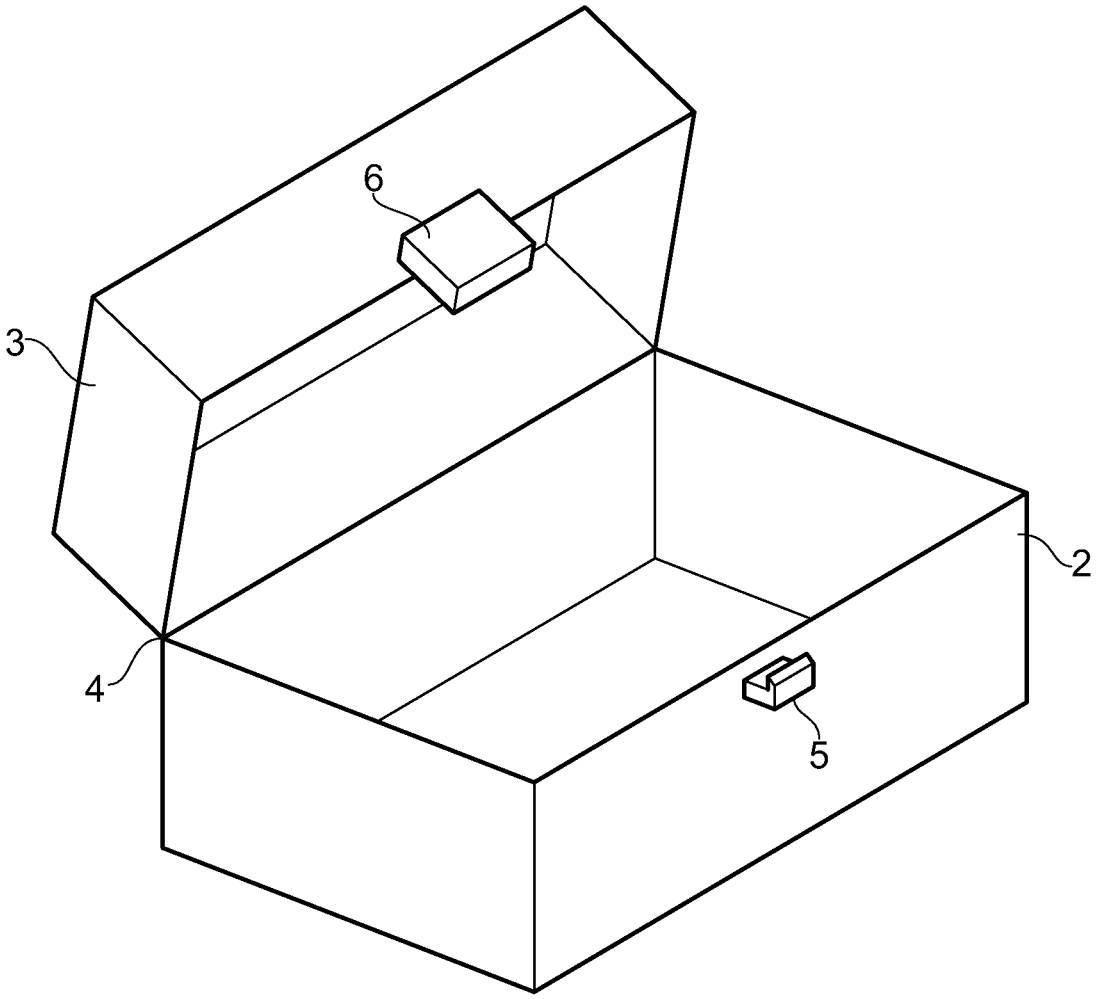
FIG. 1 is a schematic view of a container including a closure device embodying an aspect of the present invention.

FIG. 1 illustrates schematically a container 1 having a first body portion 2 and a second body portion 3. The second body portion 3 is connected with the first body portion 2 by way of a hinged connection 4, such that the first and second body portions 2 and 3 can be moved between open (as shown in FIG. 1) and closed positions. In the closed position, the first body portion 2 is held in place against the second body portion 3 by way of a closure device. The closure device includes an engagement element 5 and a clasp device 6. The clasp device 6 is arranged to engage releasably with the engagement element 5, and is attached to the second body portion 3 by way of a hinge assembly, as will be described in detail below.

Figure 2:
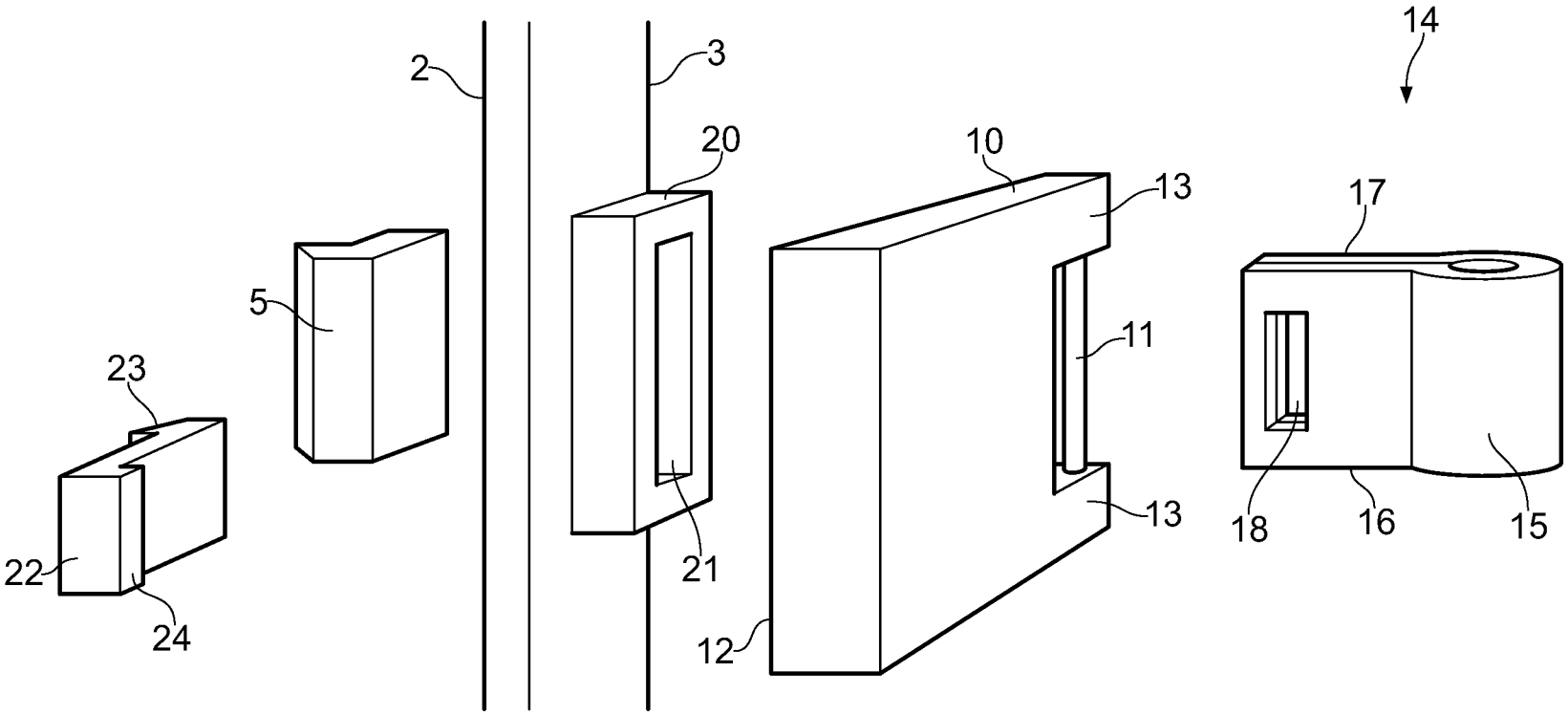
FIG. 2 shows schematic views of various components of a closure device embodying an aspect of the present invention.

FIG. 2 illustrates components of the closure device shown in FIG. 1 in an exploded form. The clasp device 6 comprises a clasp body 10 which defines an elongate pivot portion 11 at one end thereof, and an engagement portion 12 at another end thereof. The pivot portion 11 and engagement portion 12 are located at respective opposite ends of the clasp body 10. In the example shown in FIG. 2, the pivot portion extends between respective edge portions 13 of the clasp body 10.

A hinge element 14, of resilient material, comprises a partially cylindrical portion 15. The partially cylindrical portion 15 defines almost a complete cylinder, and defines an elongate aperture therethrough. First and second elongate retaining portions 16 and 17 extend adjacent one another from respective free ends of the partially cylindrical portion 15. Each retaining portion 16, 17 is provided with a locking aperture 18 therethrough. The locking apertures 18 are arranged so that they are aligned with one another, thereby providing a single locking aperture 18 that extends through both retaining portions 16 and 17. In the example shown in FIG. 2, the locking apertures extend transversely across the retaining portions 16 and 17, substantially parallel with the elongate aperture in the partially cylindrical portion 15.

A locating element 20 is provided for attaching the clasp to the second body portion 3 of the container 1, and extends from the second body portion 3. The locating element 20 defines an elongate locating aperture 21 therethrough, for receiving the first and second retaining portions 16 and 17, as will described below. A locking element 22 is provided with locking features 23 and 24, and is used to lock the hinge element 14 in place in the locating element 20. The locking element 22 may be a separate component, or may be moulded as part of the second body portion 3 and movable into place by way of a moulded hinge.

Figure 3:
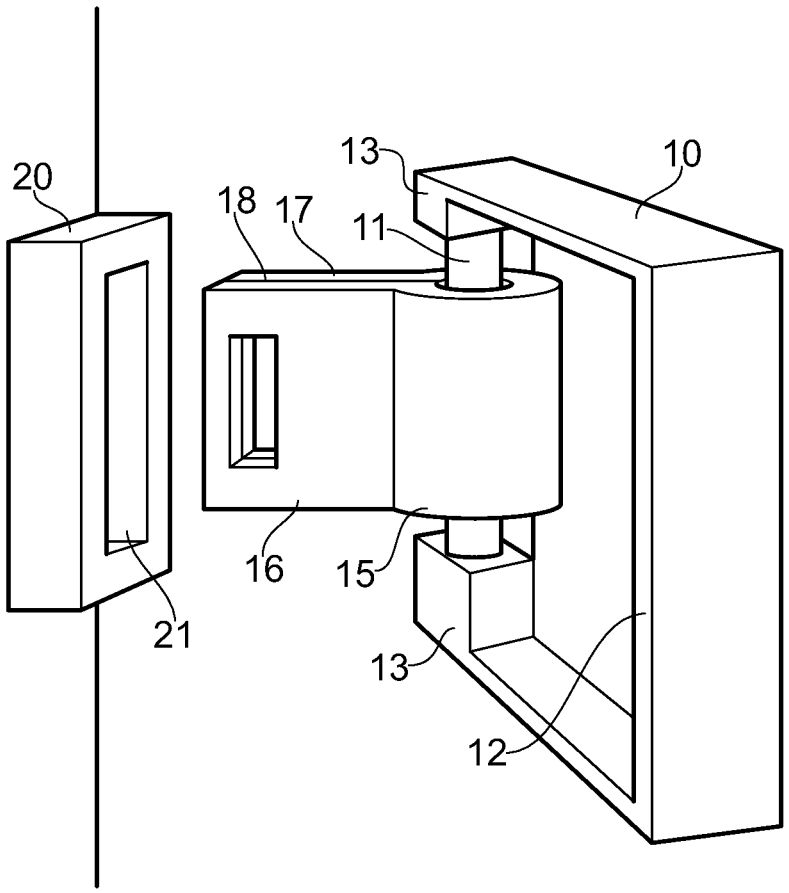
FIGS. 3 to 6 illustrate steps a closure device embodying an aspect of the present invention.

FIG. 3 illustrates the clasp device 6 in a partially completed form. The hinge element 14 is shown in place on the pivot portion 11 of the clasp body 10. The hinge portion 14 is located on the pivot portion 11 by moving the first and second retaining portions 16 and 17 apart, thereby enabling the hinge element 14 to be placed around the pivot portion 11. The pivot portion 11 extends through the cylindrical portion 15, such that the hinge element is able to rotate with respect to the pivot portion 11. The clasp body 10 is therefore able to rotate with respect to the hinge portion 14. The hinge portion 14, with attached clasp body 10 is brought adjacent to the locating element 20.

Figure 4:
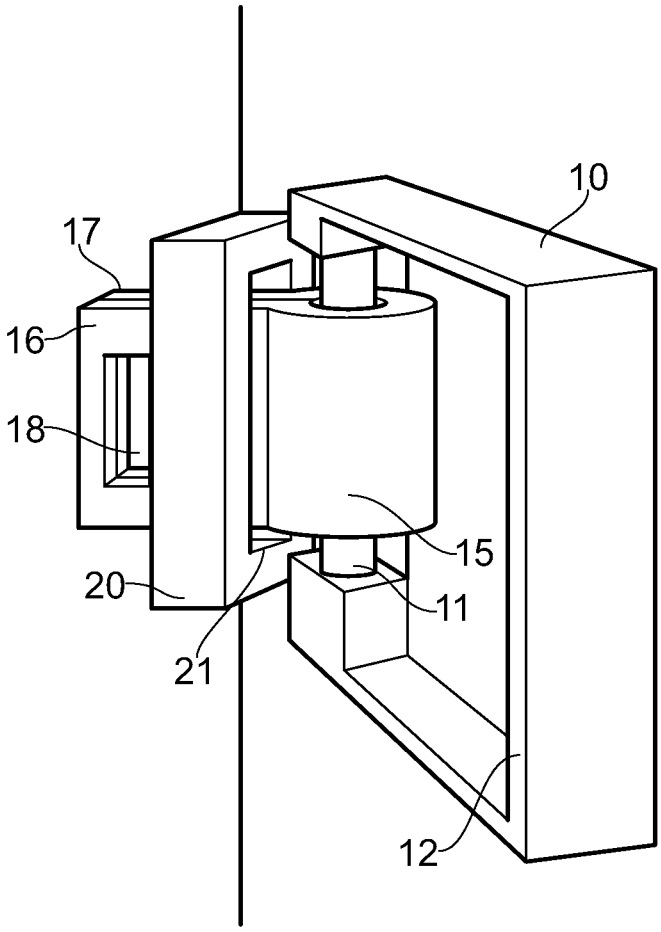

The retaining portions 16 and 17 are inserted together through the locating aperture 21, such that the hinge element 14 is located within and through the locating element 20, as shown in FIG. 4. In this example, the hinge element 14 is arranged such that the first and second retaining portions 16 and 17 tend to diverge from one another. The resilient nature of the material of the hinge element 14 means that the first and second retaining portions 16 and 17 push outwardly against inner surfaces of the locating aperture 21 of the locating element 20. This arrangement provides a frictional fit of the first and second retaining portions 16 and 17 within the locating element 20.

Since the locating element 20 is attached to the second body portion of the container 1, the clasp body 10 is able to rotate with respect to the second body portion 3 of the container 1, whilst being retained in position on the body portion 3.

Figure 5:
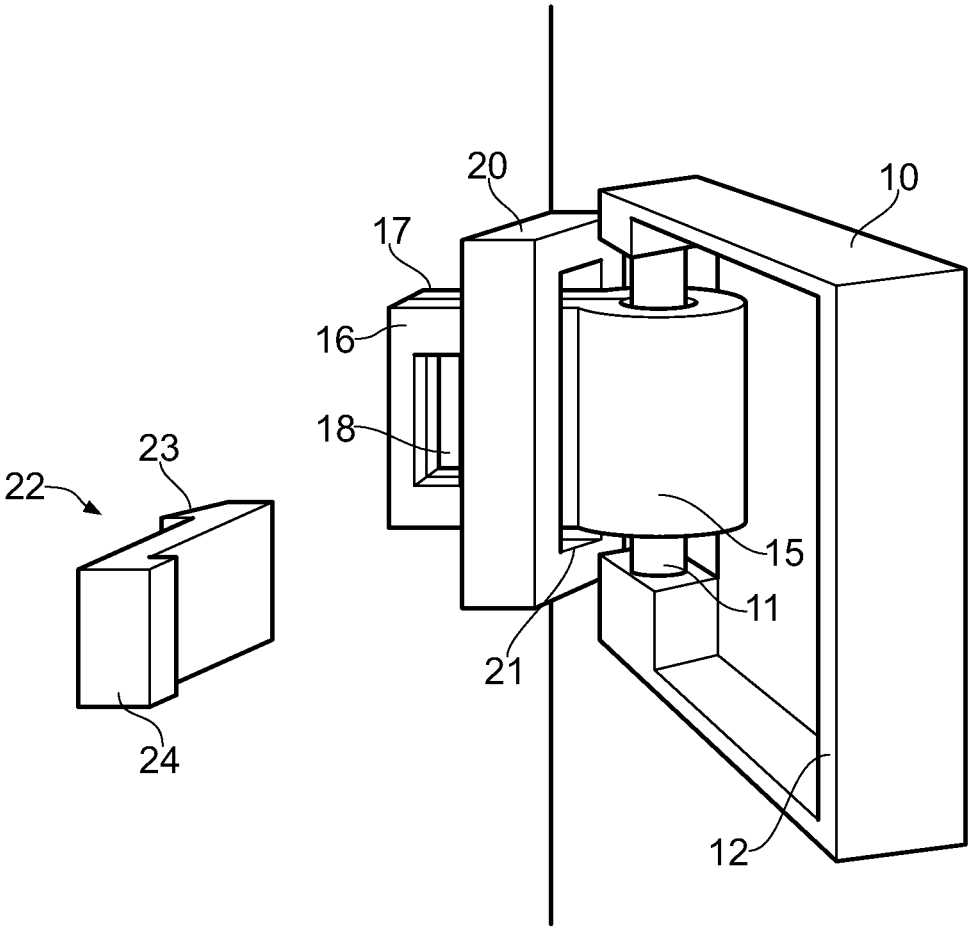
Figure 6:
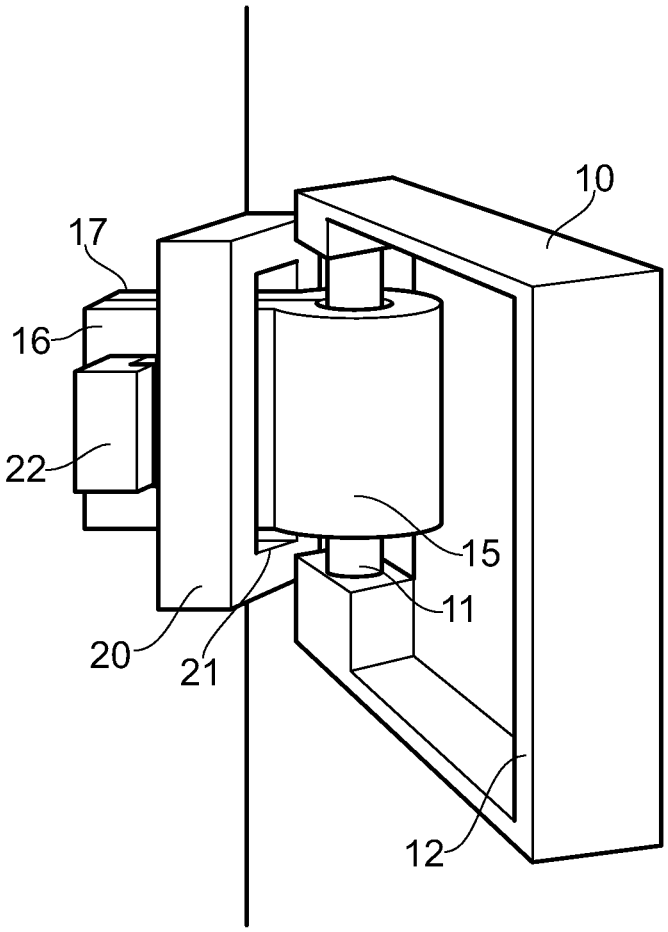

FIG. 5 illustrates the locking element 22 being inserted into the locking apertures 18 of the first and second retaining portions 16 and 17, in order to lock the hinge element 14, and hence the clasp body 10, in place in the locating element 20. The locking element 22 defines a locking feature 23 which engages with the locating element in order to retain the retaining portions of the hinge element 14 within the locating element 20. The locked arrangement is shown in FIG. 6.

In this way, the clasp body 10 is able to rotate with respect to the second body portion 3 of the container 1, by way of the pivot portion 11 rotating within the partially cylindrical portion 15 of the hinge element 14.

The locking element 22 may be a separate component, as shown in FIG. 5, or may be integral with the second body portion 3. In the latter case, the locking element 22 is moulded with the second body portion 3, and is connected thereto by way of a moulded hinge (also known as a "living hinge"). In this way, the need for a separate locking component is removed, and the manufacture of the clasp device. When attaching the clasp to the second body portion 3, it is simply necessary to rotate the locking element 22 into position in the locking aperture 18, rather than finding the component and inserting it into the locking aperture 18.

Figure 7:
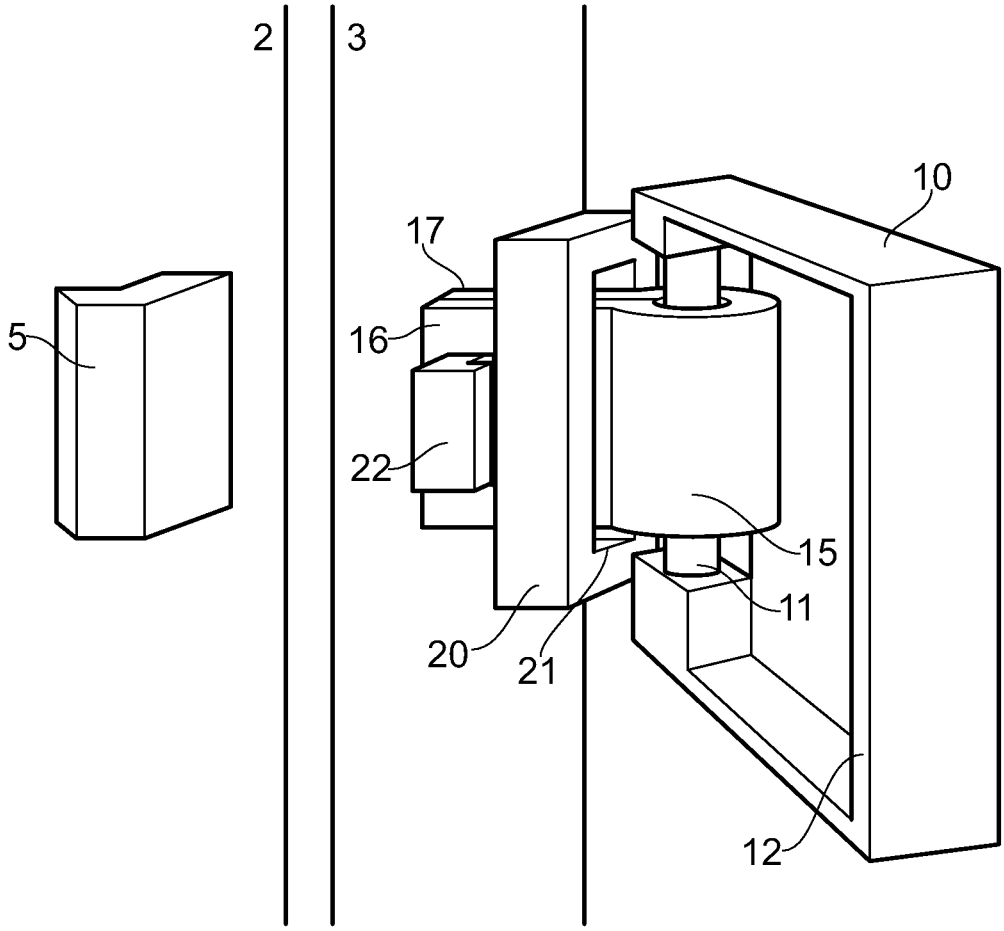
FIGS. 7 to 9 illustrate a closure device embodying the present invention in use.
Figure 8:
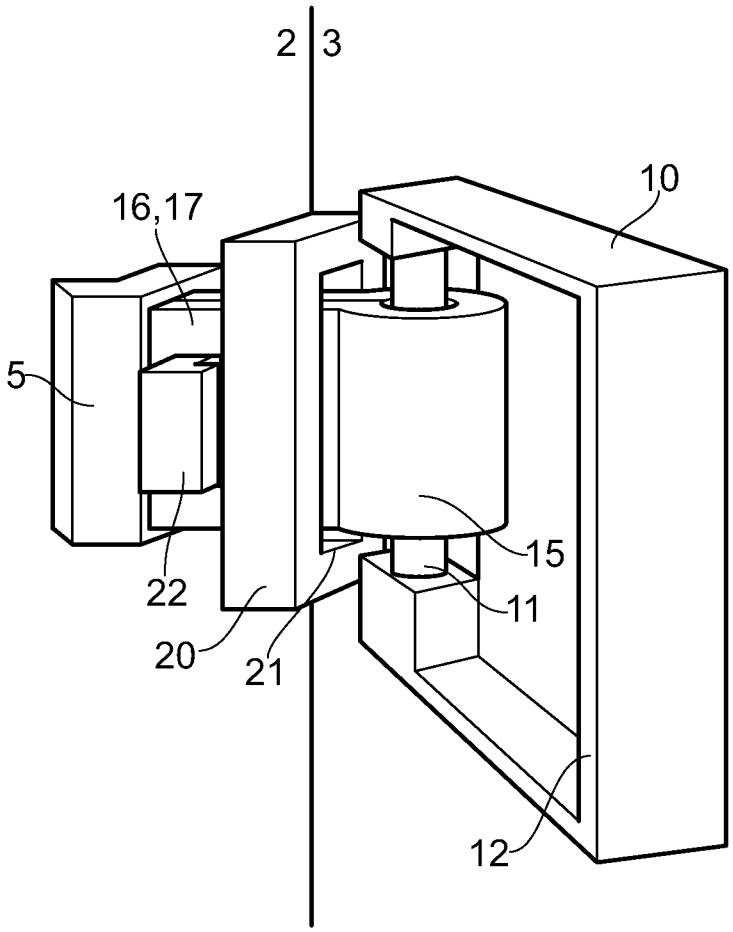

FIG. 7 illustrates the first and second body portions 2 and 3 of the container 1 being brought adjacent to one another, in order to close the container 1. The engagement element 5 and clasp 6 are also brought into close proximity in order that the container can be held closed by the closure device. FIG. 8 illustrates the container 1 in the closed position, with the engagement element 5 adjacent the hinge element 14 of the clasp 6.

Figure 9:
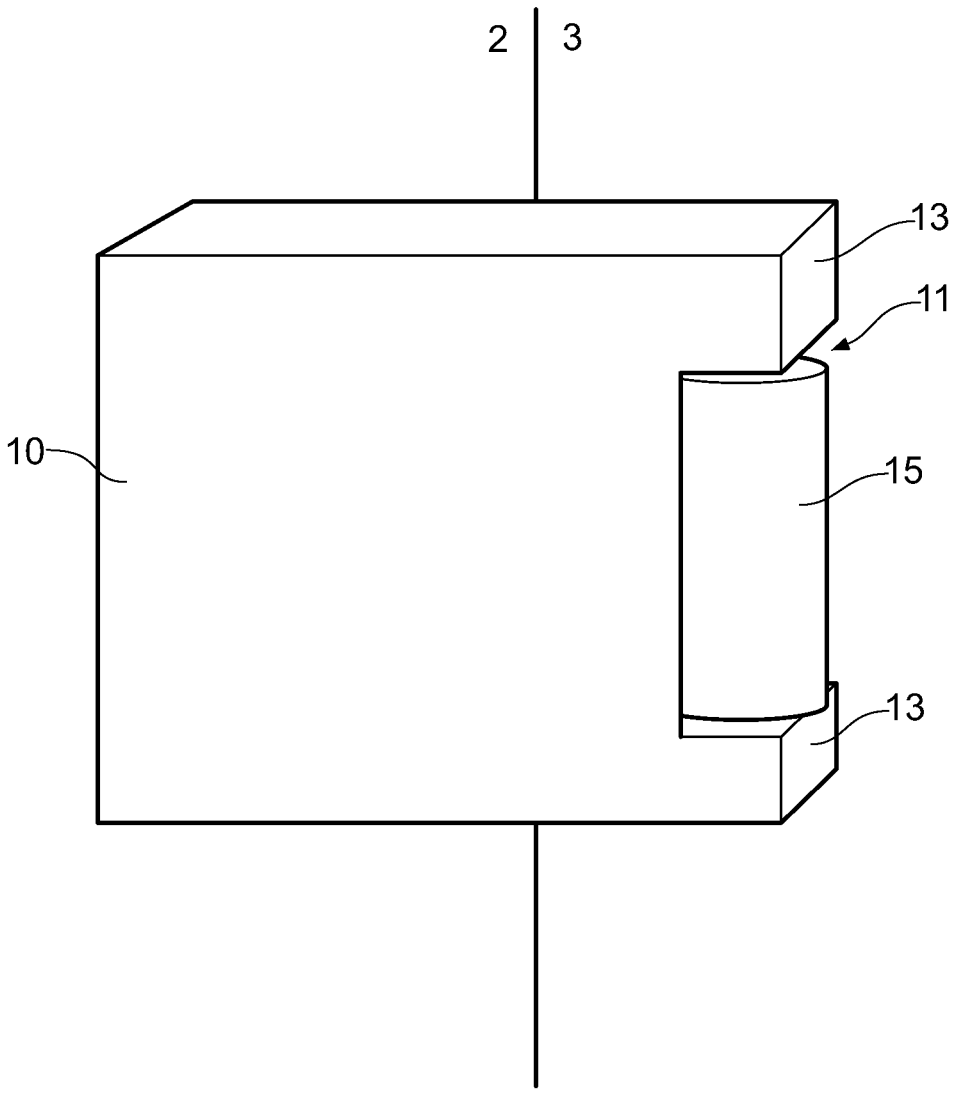

In order to hold the container 1 in the closed position, the clasp body 10 is rotated with respect to the hinge element 14, and hence with respect to the first and second body portions 2 and 3 of the container, until the engagement portion 12 of the clasp body 10 engages with the engagement element 5. This locked position is shown in FIG. 9.

The engagement element 5 and/or the clasp body 10 are of resilient material such that as the clasp body 10 is brought into engagement with the engagement element 5, either or both components are able to deform elastically slightly. This enables the components to engage, and to lock into place against one another, thereby holding the clasp 6 in place against the engagement element 5.

In such a manner, the container 1 can be held in a closed position. The closure device described is simple to manufacture and assemble, yet provide a secure and resilient closure for a container. Containers for which the closure device is particularly suitable include suitcases and other containers of "hard" plastics material.

Figure 10:
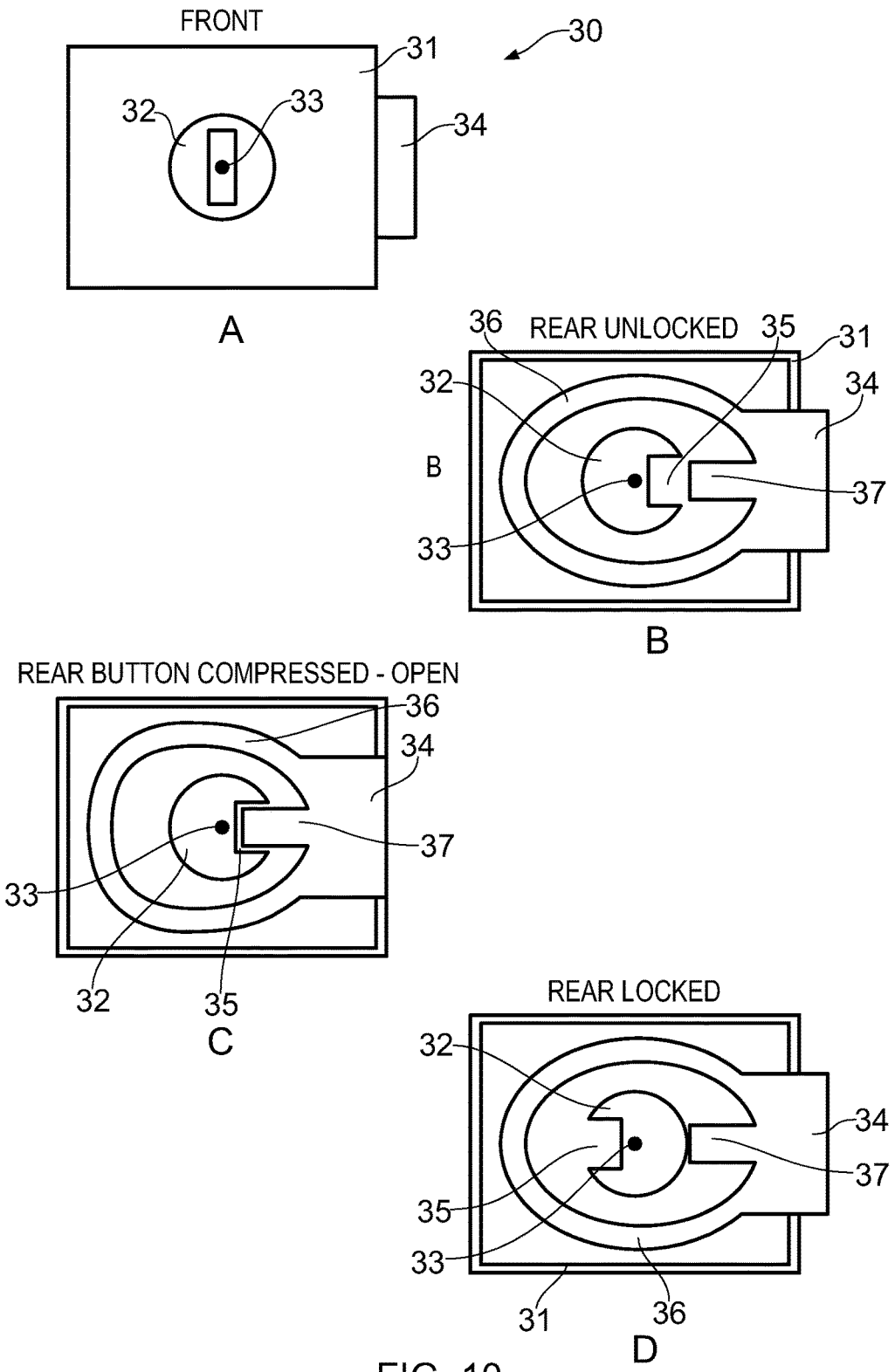
FIG. 10 illustrates a locking mechanism embodying an aspect of the present invention.

FIG. 10 illustrates a locking mechanism suitable for locking the container 1 in the closed position. The locking mechanism 30 comprises a lock body 31, onto which a lock 32 is located. The lock 32 is rotatable about an axis of rotation 33. A lock button 34 extends out from the lock body 30. FIG. 10A shows a front view of the locking mechanism 30, and FIGS. 10B to 10D illustrate rear views of the locking mechanism 30 in respective positions.

FIG. 10B shows the locking mechanism in an unlocked position. The lock 32 has a slot 35, and the lock button is mounted n the lock body 31 by a resilient member 36. The member 36 defines an interference element 37 that extends away from the button 34 toward the lock 32 and the axis of rotation 33. When the lock 32 is in the unlocked position, the slot 35 is located opposite the interference element 37, such that the interference element 37 is able to move inwardly in the lock body 31. This movement allows the button 34 to be moved inwardly of the lock body 31, thereby actuating the lock into an unlocked position, as shown in FIG. 10C.

FIG. 10D shows the locking mechanism 30 in a locked position in which the lock 32 has been rotated about the axis 33, such that the slot 35 is no longer facing the interference element 37. Instead of being movable into the slot 35, the interference element 37 is now engaged with a surface of the lock 32. This arrangement prevents the button 34 being depressed within the lock body 31. The locking mechanism is thus in a locked position.

The locking mechanism 30 can be combined with the closure device described above, with the button 34 serving to move the engagement portion 12 of the clasp body 10 in order to release the clasp body 10 from the engagement element 5. When the locking mechanism 30 is in the locked position, the button 34 is prevented from moving, and so is prevented from disengaging the clasp body 10 from the engagement element 5.

It is preferable for the closure device to be manufactured from one or more plastics material, with the various elements of the device being moulded with the first or second body portions of the container.

The invention claimed is:

1. A container comprising first and second body portions, a closure device operable to hold the first and second body portions in a closed position, the closure device including an engagement element which extends from the first body portion of the container, and a clasp attached to the second body portion of the container, and releasably engageable with the engagement element, thereby to hold the second body portion in position with respect to the first body portion, wherein the clasp includes:

a locating element which extends from the second body portion of the container and which defines a locating aperture therethrough;

a clasp body defining at one end region thereof an engagement portion for engagement with the engagement element, and having an elongate pivot portion located at another end region thereof;

a hinge element rotatably mounted on the pivot portion of the clasp body, and having a partially cylindrical portion which extends substantially around the pivot portion, the partially cylindrical portion having a first free end and a second free end, a first retaining portion extending from the first free end and a second retaining portion extending from the second free end, wherein the elongate pivot portion engages the partially cylindrical portion by sliding between the first and second retaining portions, and wherein the first and second retaining portions extend adjacent one another through the locating aperture of the locating element, wherein the hinge element is of resilient material, and is arranged such that the first and second retaining portions thereof are biased to diverge from one another, thereby providing a friction fit within the locating element.

2. A container as claimed in claim 1, wherein the first and second body portions, the locating element, the clasp body, and hinge element are of moulded plastics material.

3. A container as claimed in claim 1, wherein the clasp further comprises a locking element which engages with the first and second retaining portions, and locks the first and second retaining portions in the locating element.

4. A container as claimed in claim 1, wherein the clasp further comprises a locking element which engages with the first and second retaining portions, and locks the first and second retaining portions in the locating element, and wherein the locking element is integral with the second body portion, and is movable with respect to the second body portion into engagement with the first and second retaining portions.

5. A container as claimed in claim 4, wherein the locking element is of a plastics material and is moulded with the second body portion, the locking element being connected to the second body portion by way of a moulded hinge.

6. A container as claimed in claim 1, wherein the clasp body is movable between a closed position in which the engagement portion thereof is engaged with the engagement element, and an open position in which the engagement portion is not engaged with the engagement element.

7. A container as claimed in claim 1, further comprising a locking mechanism comprising:

a lock body;

a button resiliently mounted on the lock body, for movement with respect to the body, the button defining an interference element that extends into the lock body;

a lock rotatably mounted on the lock body, and defining a slot and a retaining surface, and rotatable between a locked position in which the interference element is substantially engaged with the retaining surface, thereby preventing movement of the interference element into the lock body, and an unlocked position in which the slot is substantially aligned with the interference element, such that the interference element is movable into the slot in a direction into the lock body.

8. A container comprising first and second body portions, a closure device operable to hold the first and second body portions in a closed position, the closure device including an engagement element which extends from the first body portion of the container, and a clasp attached to the second body portion of the container, and releasably engageable with the engagement element, thereby to hold the second body portion in position with respect to the first body portion, wherein the clasp includes:

a locating element which extends from the second body portion of the container and which defines a locating aperture therethrough;

a clasp body defining at one end region thereof an engagement portion for engagement with the engagement element, and having an elongate pivot portion located at another end region thereof;

a hinge element rotatably mounted on the pivot portion of the clasp body, and having a partially cylindrical portion which extends substantially around the pivot portion, the partially cylindrical portion having a first free end and a second free end, a first retaining portion extending from the first free end and a second retaining portion extending from the second free end, wherein the first and second retaining portions extend adjacent one another through the locating aperture of the locating element, and wherein the first and second retaining portions diverge from one another to form a space sized to receive the elongate pivot portion.

* * * * *